US005653337A

United States Patent [19]

Cirigliano

[11] Patent Number: 5,653,337

[45] Date of Patent: Aug. 5, 1997

[54] REVERSIBLE TOTE BAG

[76] Inventor: Charles F. Cirigliano, P.O. Box 3414, Nantucket, Mass. 02584

[21] Appl. No.: 529,433

[22] Filed: Sep. 18, 1995

Related U.S. Application Data

[63] Continuation-in-part of Ser. No. 270,001, Jul. 1, 1994, abandoned, which is a continuation-in-part of Ser. No. 17,876, Feb. 16, 1993, abandoned.

[51] Int. Cl.[6] ..... B65D 30/22

[52] U.S. Cl. ..... 206/373; 383/4; 224/575

[58] Field of Search ..... 206/372, 373, 206/736; 383/4, 97, 76; 224/575, 577, 153, 578, 584

[56] References Cited

U.S. PATENT DOCUMENTS 4,984,906 1/1991 Little ..... 383/97 X 5,002,401 3/1991 Blackman ..... 383/39 X

*Primary Examiner*—Jacob K. Ackun

*Attorney, Agent, or Firm*—Thomas A. Kahrl, Esq.

[57] ABSTRACT

A reversible tote bag of foldable construction for containing workmen's tools having a reversible folding wall with a reversible closure adapted to be changeable into multiple positions for ease of use and access, said reversible tote bag adapted for the storage, display, accessing and carrying of workmen tools having a unitary container panel that is closable to form a tote bag, openable to allow access thereto and reversible permitting the tote bag to be turned inside out, also a plurality of individual compartments adapted to contain workmen tools are provided and a transport device connected to the container panel for a workman to carry the bag in a plurality of modes, either by hand or on shoulders as with a knapsack. The reversible closure apparatus permits a workman to connect and disconnect the peripheral edge, so that the bag may move between at least five positions for ease of use and access.

13 Claims, 6 Drawing Sheets

REVERSIBLE TOTE BAG

CROSS REFERENCE TO RELATED APPLICATIONS

This application is a continuation-in-part of U.S. patent application Ser. No. 08/270,001 filed Jul. 1, 1994, and now abandoned, entitled Reversible Display Bag of Charles F. Cirigliano which is in turn a continuation-in-part application of U.S. patent application Ser. No. 08/017,876, entitled Display Bag of Charles F. Cirigliano, filed Feb. 16, 1993, now abandoned, which are incorporated herein by reference.

BACKGROUND OF THE INVENTION

1. Field of the Invention (Technical Field)

The present invention relates to a reversible tote bag adapted for the organization, storage, display, accessing and carrying of workmen tools.

2. Background Art

Accessing and locating workmen's tools stored in tool carriers, particularly tote bags relating to retrieval of such tools is important. Heretofore tote bags have been found a useful and inexpensive means for carrying workmen's tools to a work site, particularly heavy carpentry tools. However a tote bag is not effective in segregating the tools as they are free to intermingle and therefore finding and retrieving selected tools, once on a job site, for specific operations has been difficult and time consuming. Prior art carrying cases have attempted to remedy the problem presented by intermingling for smaller articles such as crayon and pencils by providing fold-out individual storage compartments such as pockets or pouches in the side panels of such carrying cases. Such prior art devices typically involve a container which contains pouches on an interior wall and is openable to provide access to items contained therein typically having a closure device such as hook and loop fasteners or a zipper. Such container devices typically are arranged to provide for a two position container, the first being an enclosed position for storage and transport and the second being an open position for access following release of a closure device.

The present invention overcomes the limitations expressed above of the prior technology. The present invention employs the advantageous characteristics of a reversible closure device and a reversible a tote bag having a reversible folding wall consisting of a lightweight continuous sheet of fabric. The reversible folding wall including a display panel including individual compartments for separately storing tools. In essence said display panel is attached to one side of the reversible folding wall forming the bag into at least five different positions. By providing a reversible zipper closure device extending along the peripheral edge of the sides of the bag together with a reversible folding wall, it is now possible to close the sides of the tote bag with the panel selectively either on the exterior wall, with the bag inside out, or an interior wall in a normal position.

The prior art does not present such an efficient and effective apparatus of arranging and transport of tools, particularly carpenters' tools.

For example, U.S. Pat. No. 5,002,401 to Blackman discloses an article holder and carrier for small articles such as crayons, coins and pencils in a boxlike holder formed by a plurality of fabric walls sequentially hinged together and a plurality of pockets which fold together to form a series of compartments provided with shock-absorbing material. The Blackman device includes a closure device consisting of a plurality of hook and loop fasteners mounted on flaps. These fasteners may be individually disconnected and the article holder and the carrier may be unfolded into a generally flat position exposing pockets which largely conceal articles from view and protects them from shock. Unlike the present invention, Blackman is not a display device even when unfolded, is not reversible to place the pockets outside, fails to teach a container other than the pouches and does not teach a carrier for heavy articles such as tools. The Blackman device simply would not work as a carrier for tools such as hammers and saws. Furthermore the Blackman device is directed to the problem of protecting items inside the boxlike structure by including stiffening partitions and shock absorbing material. Accordingly, placing the pouches on an outside wall would defeat the object of Blackman. Moreover the patent to Blackman discloses an article holder and carrier for small articles limited to two positions and fails to teach a multiple position bag for organization, storage, display, accessing and carrying of heavy articles such as workmens' tools.

U.S. Pat. No. 4,984,906 to Little discloses a multipurpose utility tote consisting of a flat t-shaped unit having a zipper operable to transform the t-shaped unit into a parallelpiped shaped container which can be closed for storage and can be opened to provide a flat surface essentially providing a two positioned tote.

U.S. Pat. No. 2,442,105 to Vacheron discloses a multipurpose blanket having a zipper mounted on a panel edge so as to provide that the blanket may act as an independent container for other articles. The blanket of Vacheron is essentially a two position blanket which can also serve as a container.

Despite the teachings of the prior art, there has not been a device for workmen's tools employing a reversible wall in combination with a reversible closure for providing for multiple positions for ease of use and access. Accordingly, it is desirable to provide for a new and improved tote bag employing a reversible zipper making the tote bag reversible to provide for total access to items stowed in the bag or in its compartments and lightness of weight which overcomes at least some of the disadvantages of prior art; and it is lightweight and economical. The present invention permits this by employing a novel reversible zipper device and by the application of its inherent parts.

SUMMARY OF THE INVENTION

The present invention is directed to a reversible tote bag of foldable construction for containing workmen's tools having a reversible folding wall with a reversible closure apparatus adapted to be changeable into multiple positions for ease of use and access.

In particular, the invention comprises a reversible tote bag adapted for the storage, display, accessing and carrying of workmen tools that is closable to form a tote bag, openable to allow access thereto and reversible permitting the tote bag to be turned inside out. Said tote bag comprises a unitary reversible folding wall comprised of a foldable fabric material having a generally rectangular body with a generally rectangular bottom panel of smaller size arranged in an orthogonal relationship to the body. The folding wall consists of a container panel having a first side, a second side, a top edge and side edges and a bottom edge which together define a peripheral edge. A plurality of individual compartments adapted to contain workmen tools are provided secured to the first side of the body.

The tote bag of the present invention includes a transport device connected to the container panel for a workman to carry the bag in a plurality of modes, either by hand or by backpack with shoulder straps as with a knapsack. Also, provided is a closure device employing a cord to permit a workman to selectively move the top edge of the bag between an open and closed position.

In the present invention the reversible closure apparatus consists of a reversible zipper extending about the peripheral edge to permit a workman to connect and disconnect the peripheral edge, so that the bag may move between;

i) a storage and carrying position wherein the peripheral edge is connected by the zipper means with the first side of the container panel facing inwardly for carrying workmens' tools on an inner wall of the tote bag;

ii) an open display position without the connection of the peripheral edge arranged for displaying and accessing articles of workmens' tools contained in individual compartments;

iii) a reversed storage, accessing and carrying position wherein the peripheral edge is connected by the zipper means with the first side of the container panel outwardly for carrying workmens' tools on an outside wall of the tote bag;

iv) an open and closed mode for the open top by moving a rope between a drawn/closed position and a released, open position;

v) a knapsack position wherein a selected carrying strap is a moveable web for use for providing a pair of shoulder straps for carrying said tote bag on a workers back, and;

vi) a tool roll position wherein the container panel is moved between a coplanar display and accessing position by rolling from right to left inwardly on the display panel and tying the roll thus formed with a cord.

Accordingly, the object and purpose of the present invention is to provide an improved reversible tote bag adapted which may be moved between multiple positions, for the storage, display, accessing and carrying of workmen tools.

Another object of the present invention is to provide a reversible folding wall including a display panel having including individual compartments for separately storing tools.

Another object of the present invention is to provide a reversible zipper closure device extending along the peripheral edge of the sides of the bag together with a reversible folding wall such that it is possible to close the sides of the tote bag with the panel selectively either on the exterior wall, with the bag inside out, or an interior wall in a normal position.

An additional object of the present invention is to provide for selectively drawing the opening at top of the tote bag closed Another object of the present invention is to permit a workman to connect and disconnect the peripheral edge of the bag selectively by moving the reversible zipper extending about the peripheral edge to arrange the bag in a plurality of at least six positions.

An additional object of the present invention is to provide that with the articles of tools arranged with the panel on the exterior wall, it is adapted to provide storage and display for tools on the exterior wall and also provide an open segregated storage area for articles such as soft goods or food.

The invention will be described for the purposes of illustration only in connection with certain embodiments. However, it is recognized that those persons skilled in the art may make various changes, modifications, improvements and additions on the illustrated embodiments all without departing from the spirit and scope of the invention.

BRIEF DESCRIPTION OF THE DRAWINGS

The accompanying drawings, which are incorporated into and form a part of the specification, illustrate several embodiments of the present invention and together with the description serve to explain the principals of the invention. The drawings are only for the purpose of illustrating a preferred embodiment of the invention and are not construed as limiting the invention.

DETAILED DESCRIPTION OF THE PREFERRED EMBODIMENT

Figure 1:
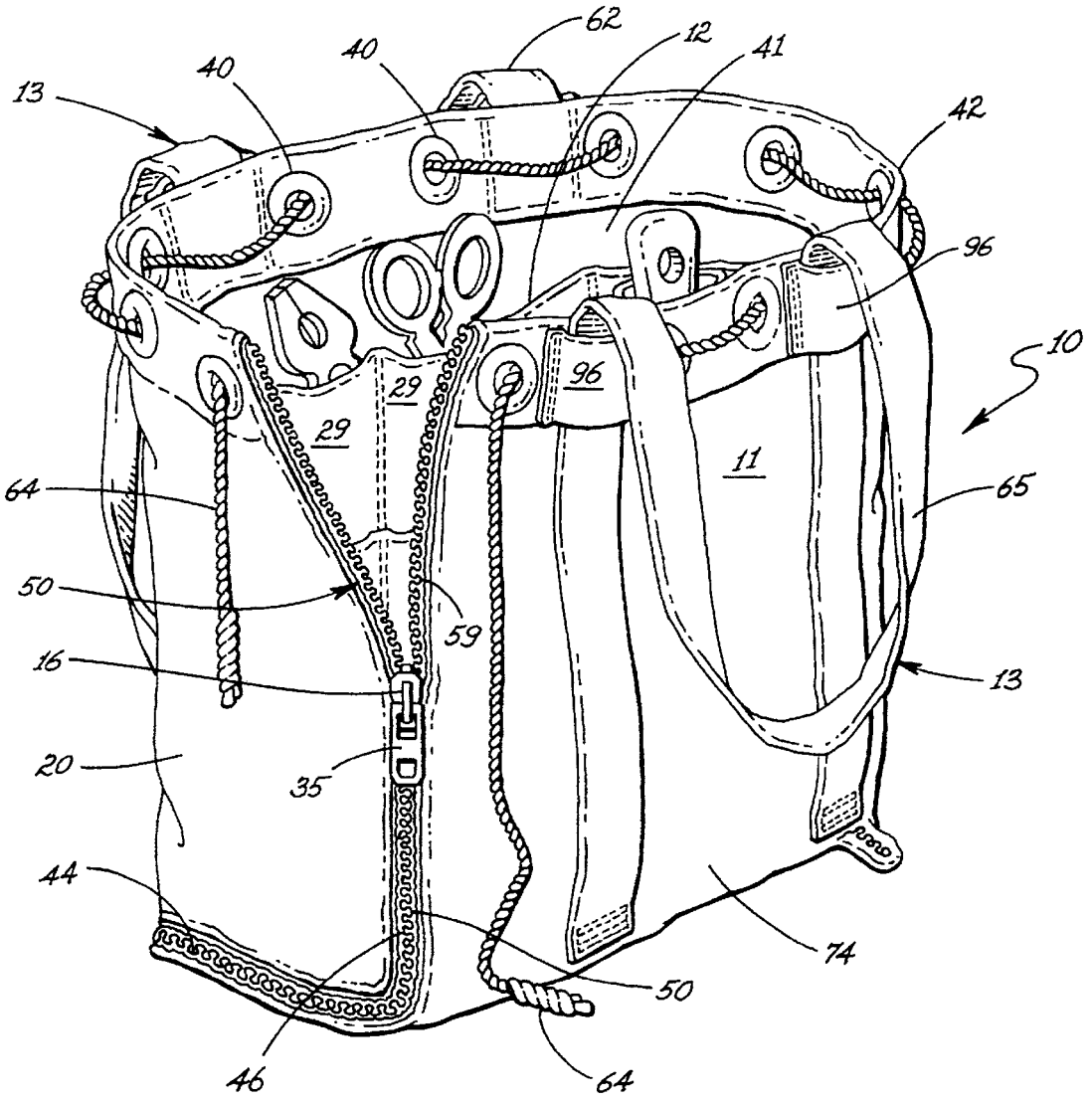
FIG. 1 is a perspective view of the reversible tote bag of the present invention shown in a storage and carrying position wherein workmens' tools are carried on an inner wall of the tote bag.

Referring to the drawings, there is in FIGS. 1–7 shown a reversible tote bag 10 consisting of a container panel 11 configured to organize workmens's tools 18 having a pair of handles 13 mounted on a display panel 12, arranged to be accessed by means a reversible closure apparatus 16 connected with an associated continuous seam 14, wherein said reversible tote bag may be arranged in one of at least six positions for ease of access and use.

Figure 2:
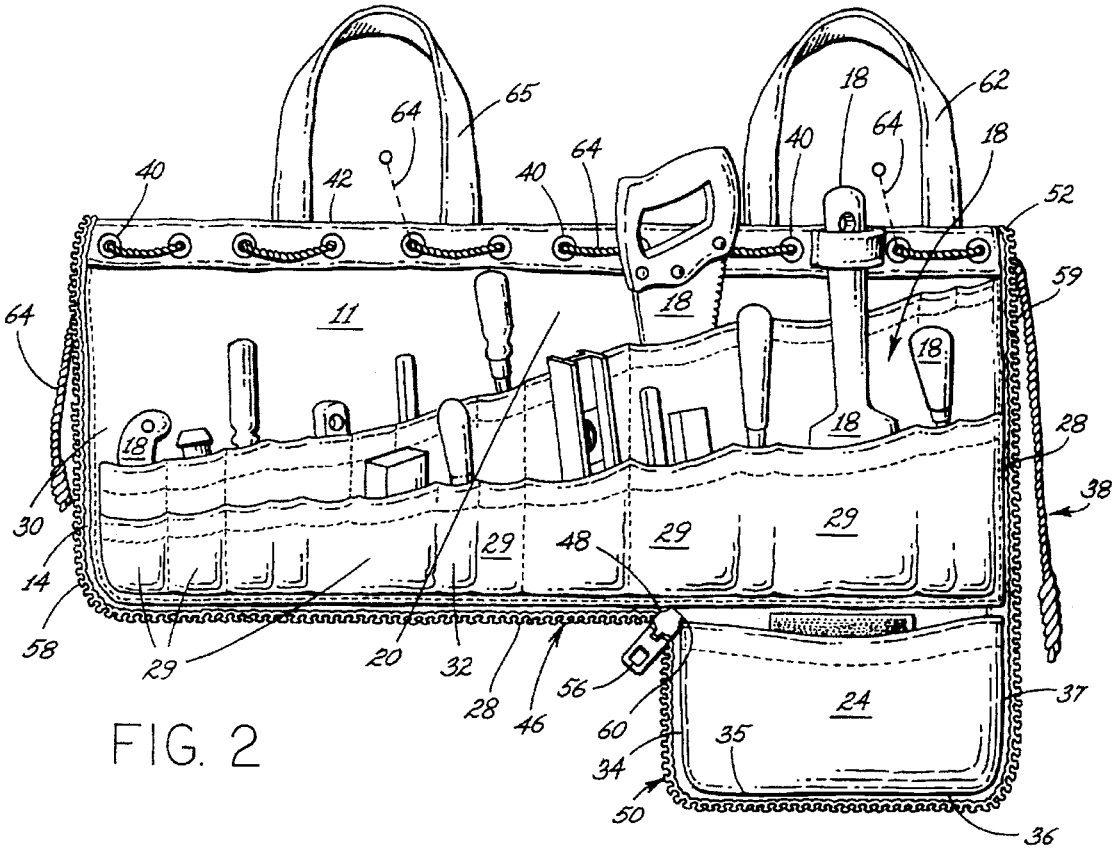
FIG. 2 is a plan view of the reversible tote bag of the invention of FIG. 1 shown in the open display position arranged for displaying and accessing articles contained in individual compartments.
Figure 3:
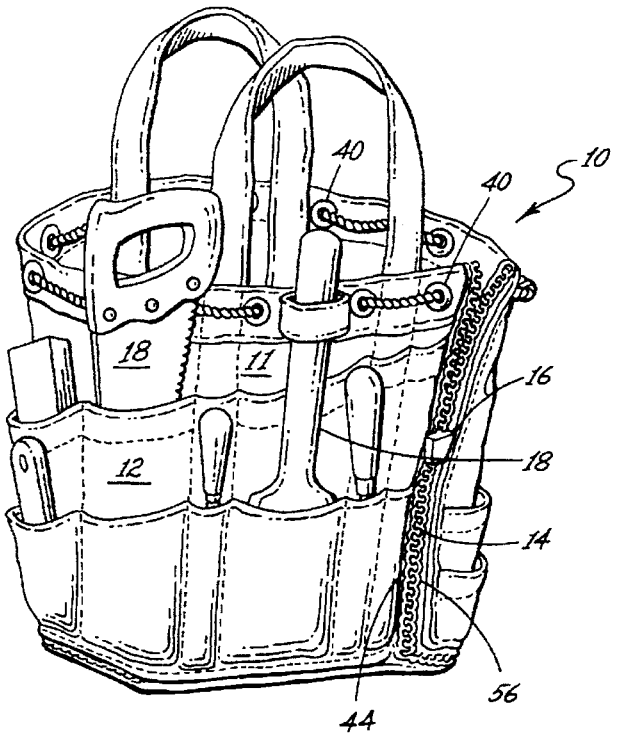
FIG. 3 is a perspective view of the reversible tote bag of FIG. 1 in a reversed storage, accessing and carrying position wherein workmens' tools are carried on an outer wall of the tote bag.
Figure 4:
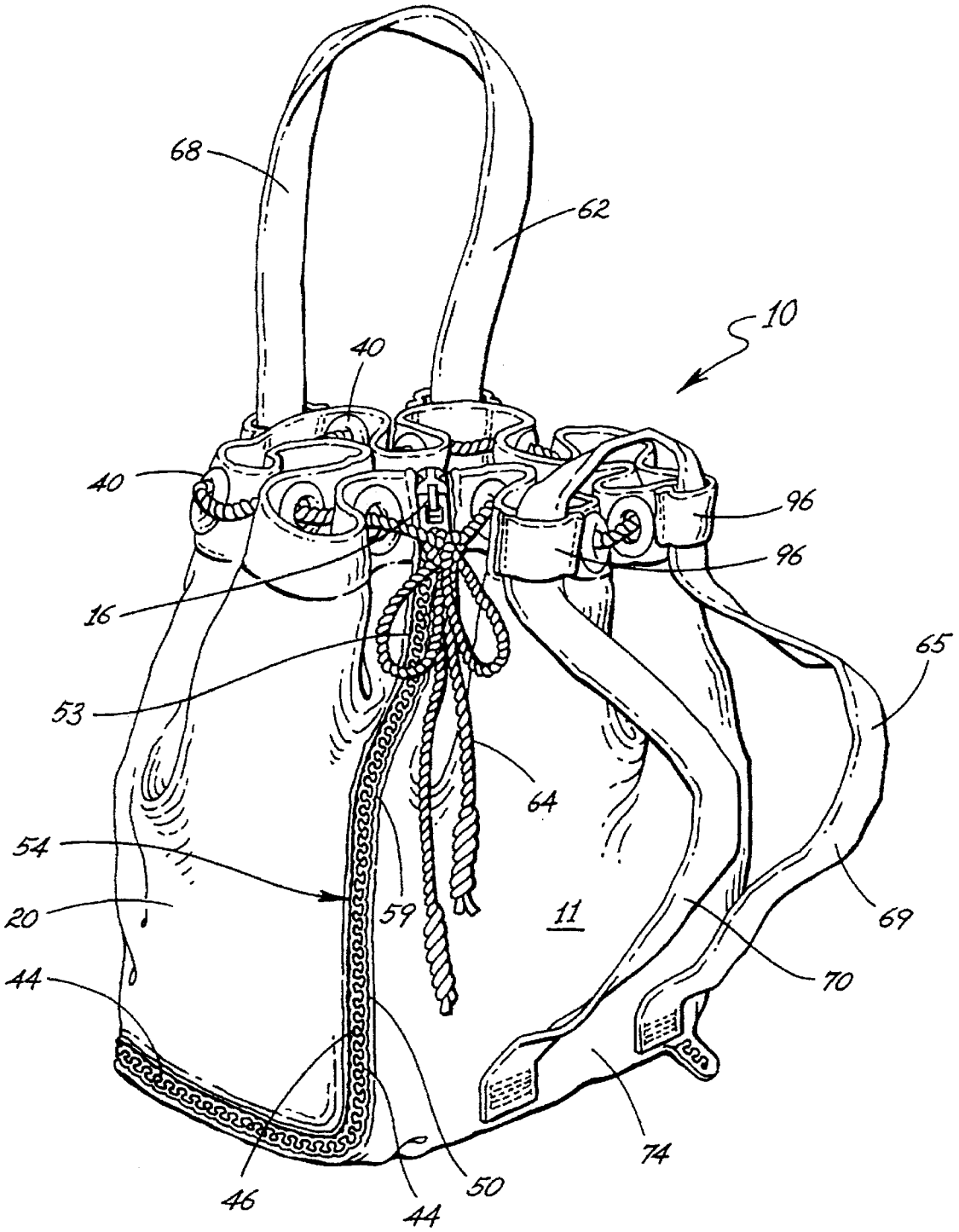
FIG. 4 is a perspective view of the reversible tote bag of FIG. 1 in a knapsack position with the top in a closed mode with the cord pulled.
Figure 5:
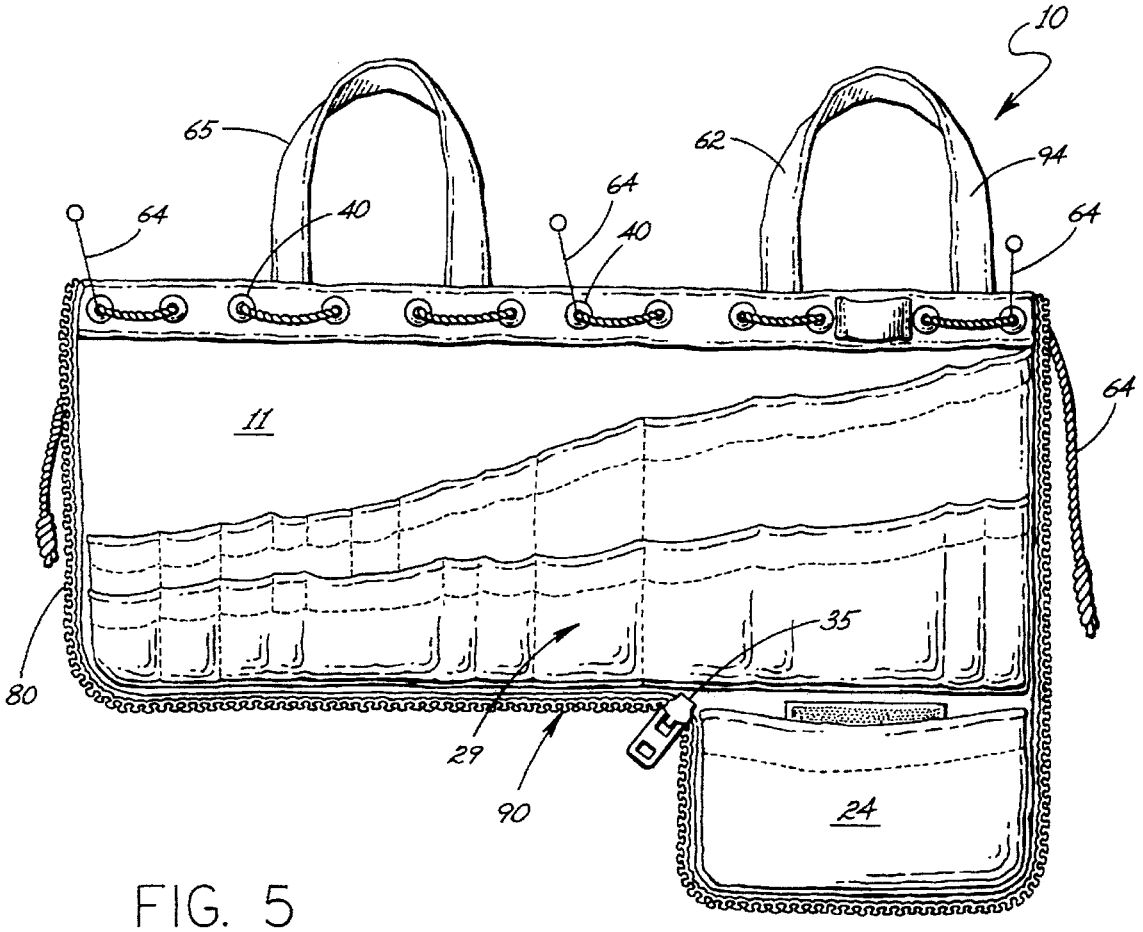
FIG. 5 is a plan view of the reversible tote bag of the present invention of FIG. 1 in a display rack position where it is arranged to be hung as a display rack.

In the preferred embodiment as is shown in FIGS. 1–7 the invention is directed to a reversible tote bag 10 adapted for storage, display, accessing and carrying of workmen tools 18, having a container panel 11 in the form of a reversible folding wall having a first side 17 and a second side 19 that is closable to form an enclosed tote bag for carrying tools, openable to allow access thereto and reversible permitting said tote bag to be turned inside out. Container panel 11 is constructed of a continuous sheet of foldable fabric material having a generally rectangular body 15 with a generally rectangular bottom panel 24 of smaller size arranged in an orthogonal relationship to said body. Container panel 11 includes a top edge 21, a bottom edge 23, and side edges 25 which together define a continuous peripheral edge 28 shown generally at in FIG. 2. Also, as is shown in FIGS. 2,3 & 5 said container panel includes a plurality of individual compartments 29 adapted to contain assorted workmen tools 18, said compartments being secured to the first side 17 of container panel 11.

Figure 6:
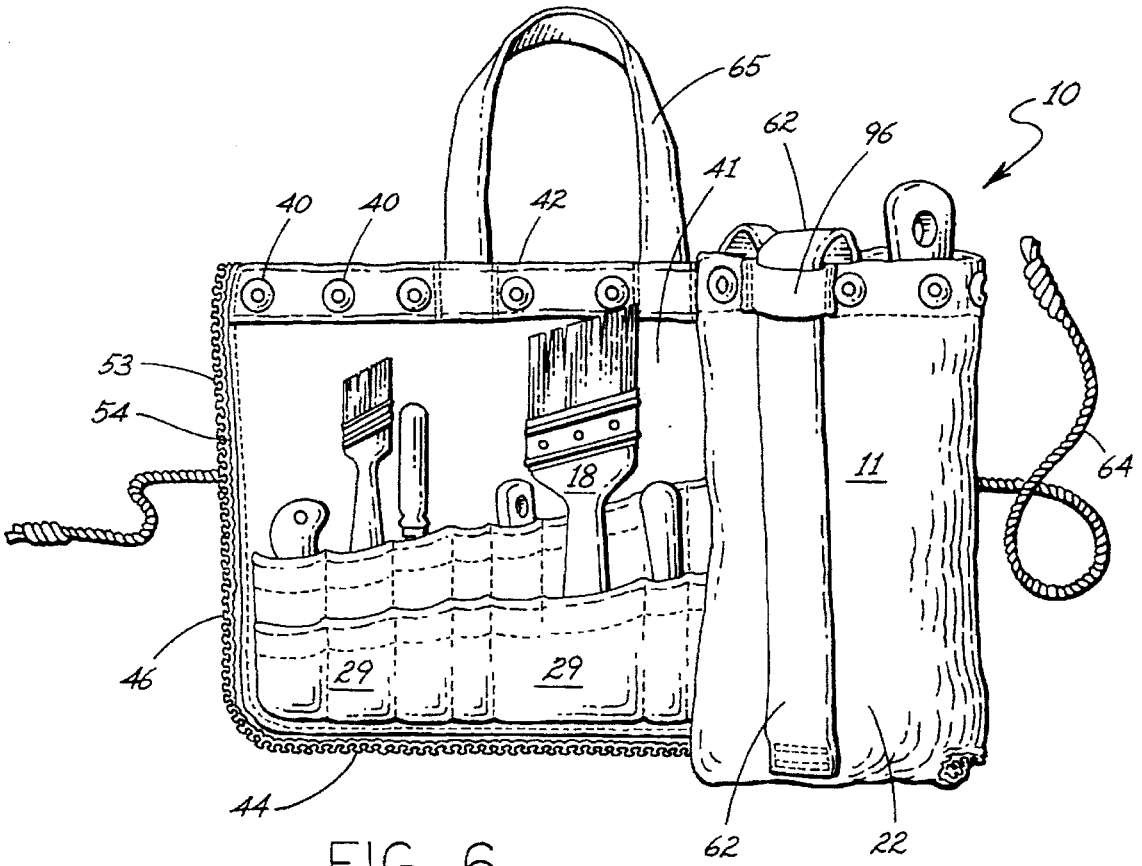
FIG. 6 is a perspective view of the reversible tote bag of FIG. 1 shown in a tool roll position including workmen's tools, partially rolled.
Figure 7:
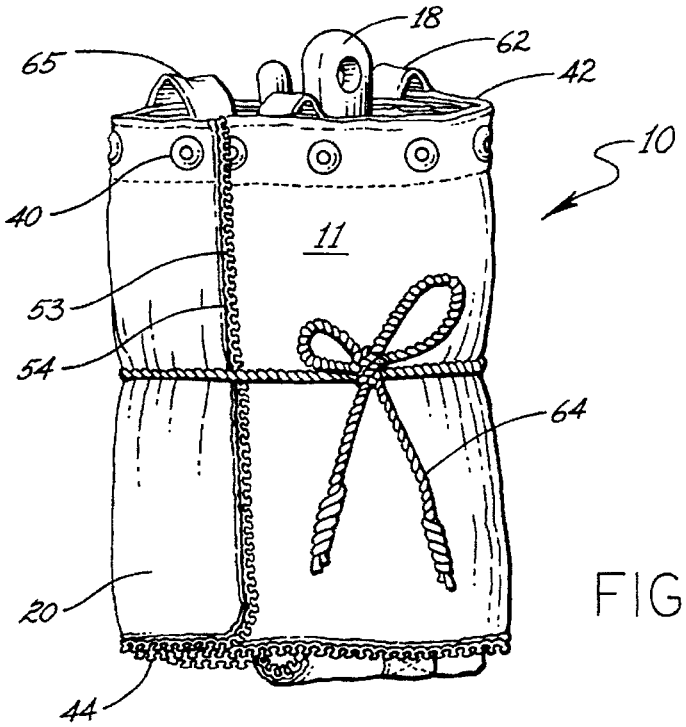
FIG. 7 is the perspective view of reversible display bag of the reversible tote bag of FIG. 1 in the fully rolled position being secured by a rope.

In the preferred embodiment, the reversible tote bag 10 comprises a closure apparatus 16, consisting of a reversible zipper 35 extending about peripheral edge 28 configured to permit a workman to connect and disconnect said peripheral edge, so that tote bag 10 may move between multiple positions as follows;

a first position being shown in FIG. 1 displaying a storage and carrying position wherein peripheral 28 is connected by the zipper closure apparatus 16 with the first side 17 of container panel 11 facing inwardly; and wherein workmens' tools 18 are carried on an inner wall of said tote bag;

a second position being shown in FIG. 2 displaying a coplanar display and accessing position without the connection of the peripheral edge 28 for displaying and accessing articles 18 contained in individual compartments 29;

a third position being shown in FIG. 3 displaying a reverse storage, accessing and carrying position wherein the peripheral edge 28 is connected by the zipper closure apparatus 16 with the first side 17 facing outwardly and workmens' tools are 18 carried on an outer exposed side of tote bag 10;

a fourth position being shown in FIG. 4 displaying a an open and closed mode for the open top 41 by moving a cord 64 between a drawn/closed position and a released/open position; the fifth position being shown in FIG. 4 displaying a knapsack position wherein a selected storage and carrying strap 67 is extended for use in carrying the tote on a worker's back; and a sixth position being shown in FIG. 5 displaying a display rack position where container panel 11 is arranged to be hung from nails 44 as a display rack a seventh position being shown in FIGS. 6 & 7 displaying a tool roll position wherein container panel 11 is moved between the coplanar display and accessing position without the connection of the peripheral edges 28 by rolling from right to left inwardly on display panel 12 and tying the roll thus formed with the cord 64 with drawn from eyelets 40.

Said closure apparatus 16 comprises a double headed zipper 35 and a pair of cooperating zipper chains of teeth 58 and 59. In the preferred embodiment, a chain of teeth 59 is located along the second fastener segment 50 of said container panel, wherein said first and second zipper chain of teeth are joined at a bottom end piece 60 fastened at the common interior corner 48.

As displayed in FIGS. 1 and 2, the reversible tote bag 10 also includes a plurality of reinforced eyelet devices 40, positioned in defined spaced relationship along an top edge 42 of said container panel, said edge defining the reversible tote bag 10 top opening 41. As shown in FIG. 2, continuous seam 14 extends around the peripheral edge 28, having a first fastener segment 46 joined, at a common interior corner 48 of the longitudinal section 20 and the transverse section 22, to a second fastener segment 50, the opposite end of said first fastener segment comprising a distal end 52, and the opposite end of the second fastener segment comprising a second distal end 54.

In the preferred embodiment, a means of transport comprising handles 13 are provided, said means of transport connected to the container panel 11 for a workman to selectively carry the tote bag 10 gripped by hand or carried on the workman's shoulders. The handles 13 includes two members consisting of a first conventional tote bag handle 62 and a moveable web 65 slidably mounted on back 74 of tote bag 10 for mounting said bag in knapsack fashion on the shoulders of an individual. As is shown in FIG. 4, the moveable web 65 is slidably held by a pair of guides 96 connected at the top edge 42 of said tote bag permitting movement of said web between a tote bag handle position with a loop segment 68 extending upwardly, and a shoulder harness position wherein two loop segments 69 and 70 are drawn outwardly to form a pair of shoulder straps 98.

As is shown in FIG. 4 the reversible tote bag of FIG. 1 can be arranged in a knapsack position wherein a selected carrying strap 67 is a moveable web 65 is shown in the extended position for use for providing a pair of shoulder straps for carrying said tote bag on a workers back. There is also shown in FIG. 4 the reversible tote bag of FIG. 1 with the open top 41 of said tote bag shown in a drawn closed position secured by cord 64 extending through eyelets 40.

As is shown in FIGS. 1 through 6 means for closure are provided comprising a cinch cord 64 to permit a workman to move top edge 42 of tote bag 10 between an open and closed position. The reversible closure apparatus comprises 16 a reversible zipper 35 extending about the peripheral edge to permit a workman to connect and disconnect said peripheral edge.

Figure 8:
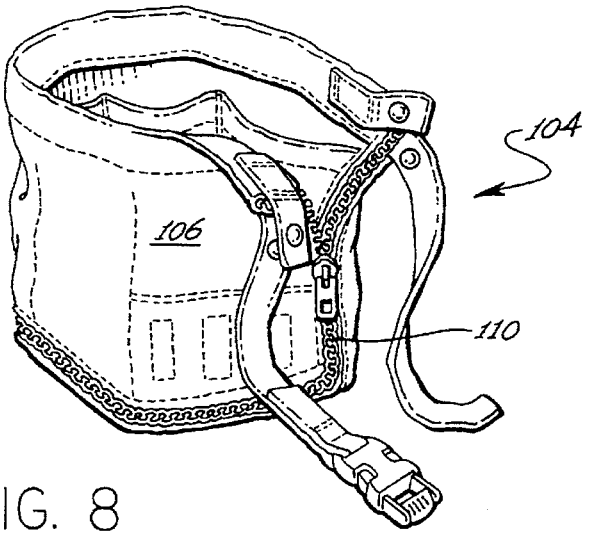
FIG. 8 is a perspective view of the exterior of an alternate embodiment of the present invention arranged as a utility apron convertible in to a bag shown in the bag position.
Figure 9:
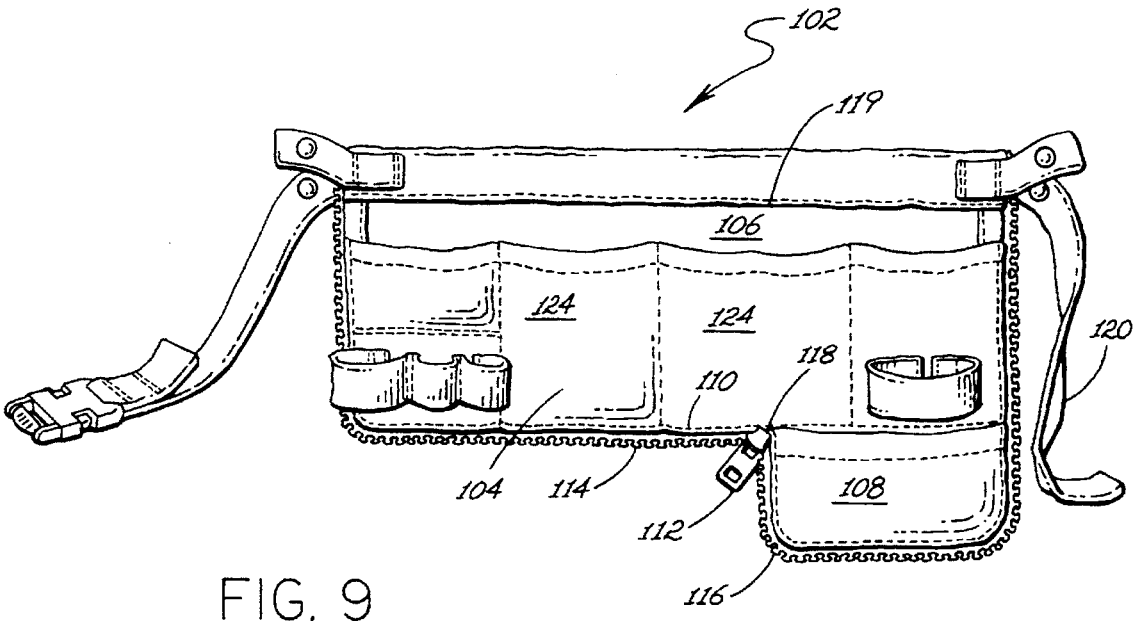
FIG. 9 is a plan view of the utility apron embodiment of FIG. 8 shown in the open apron position.

As is shown in FIG. 8 reversible tote bag 10 is shown in a tool roll position including workmen's tools, partially rolled, and in FIG. 9 the reversible tote bag 10 is shown in a fully rolled position being secured by cord 64.

Referring to FIG. 2, the reversible tote bag 10 may be suspended in a vertical plane from nails 67 driven in construction framing not shown extending through the spaced reinforced eyelets 40, with the articles, shown as tools 26, individually arranged in separate compartments 29 formed in display panel 12, and with the semi-detached bottom panel 24 depending from the bottom of said display panel. Said bottom panel has a separate transverse pocket 68 for containing small items such as nails, measuring sticks, and pencils, extending laterally and having a Velcro® fastener at the top.

As is shown in FIGS. 8 & 9 an alternate utility apron embodiment of the present invention having a display panel in the form of an apron, and a reversible zipper closure device. In this embodiment of the invention shown in FIGS. 8 and 9, there is provided a utility apron 102 that is reversible to form a nail bag 104 for transporting and displaying fasteners, typically nails 64 of various sizes comprising a unitary container panel 106 that is closable to form a nail bag, and openable to allow access thereto, of generally rectangular, "L" shaped construction having a semi-detached bottom panel 108, hingedly attached adjacent one end of said container panel extending outwardly orthogonal relationship thereto; a continuous seam 110 extending around the peripheral edges of said container panel and double headed zipper 35 joining a first fastener segment 114 and a second fastener segment 116 joined at a common point 118; a hammer loop 119 and a strap 120 for hanging the nail bag from a user's waist and for drawing the oval opening of said nail bag closed includes a pair of snap buckles 126. In this embodiment a pair of handles 122 are provided and said display apparatus is adapted for organizing and displaying a plurality individual nail compartment 124 fastened to said container panel.

Tote bag 10 preferably is constructed of flexible, resilient material, in particular, "CORDURA,"® 1000 denier fabric, or alternatively cotton duck canvas, or polyester material.

What is claimed is:

1. A reversible tote bag adapted for the storage, display, accessing and carrying of workmens' tools, which bag comprises:

a) a container panel comprised of a foldable fabric material and having a generally rectangular body with a generally rectangular bottom panel of smaller size in an orthogonal relationship to the body;

b) said panel having a first side and a second side, a top edge, side edges and a bottom edge which together define a peripheral edge;

c) a plurality of individual compartments adapted to contain workmens' tools, the compartments secured to the first side of the body;

d) transport means connected to the container panel for a workman to carry the bag;

e) closure means to permit a workman to move top edge of the bag between an open and closed position;

f) reversible zipper means extending about the peripheral edge to permit a workman to connect and disconnect the peripheral edge, so that the bag may move between;

i) a storage and carrying position wherein the peripheral edge is connected by the zipper means with the first side of the panel facing inwardly;

ii) a coplanar display and accessing position without the connection of the peripheral edges;

iii) a reverse storage, accessing and carrying position wherein the peripheral edge is connected by the zipper means with the front side facing outwardly;

iv) an open and closed mode for the top edge by moving a cord between a drawn/closed position and a released/open position;

v) a tool roll position wherein the bag is moved between the coplanar display and accessing position without the connection of the peripheral edges by rolling from right to left inwardly on the container panel and tying the roll thus formed with the cord; and vi) a knapsack position wherein in the storage and carrying position straps are extended for use in carrying the tote on a worker's back.

2. The bag of claim 1 whereinthe reversible zipper means includes a double headed zipper.

3. The bag of claim 1 wherein the transport means comprises closed loop reversible handles consisting of a fixed handle and a moveable web handle.

4. In combination, the bag of claim 1 with a plurality of workmens' tools disposed respectively in compartments.

5. The bag of claim 3 wherein the moveable web handle is configured to move between a handle position and a spaced-apart shoulder strap position whereby the tote bag may be carried as a knapsack.

6. The bag of claim 1 wherein the plurality of compartments are comprised of a foldable material secured to the the container panel.

7. In combination the bag of claim 4 wherein, with the articles of tools arranged with the panel on the exterior wall, the tote bag is adapted to provide storage and display for tools on the exterior wall and also provide an open segregated storage area for articles such as soft goods or food.

8. In combination, the bag of claim 1 and suspension means comprising nails extending from framing means to permit the hanging of the bag in a display and accessing position from suspension means.

9. The bag of claim 1 wherein the cord associates with a plurality of spaced-apart holes in eyelets along the top edge and a cord interwoven through the holes for providing for closure of said tote bag.

10. The bag of claim 1 wherein the foldable fabric material comprises a canvas material.

11. The bag of claim 1 wherein the bottom panel includes a pocket-type compartment in the first side.

12. A reversible tote bag adapted for the storage, display, accessing and carrying of workmens' tools, which bag in combination with a plurality of workmens' tools disposed respectively in a plurality of compartments in the tote bag comprises:

a) a container panel comprised of a foldable fabric material and having a generally rectangular body with a generally rectangular bottom panel of smaller size in an orthogonal relationship to the body;

b) said panel having a first side and a second side, a top edge and side edges, and side edges and a bottom edge which define a peripheral edge;

c) a plurality of individual compartments adapted to contain workmens' tools, the compartments secured to the first side of the body and said compartments are comprised of foldable material secured to the first side, and the compartments;

d) a plurality of workmens' tools disposed respectively in a plurality of compartments in the tote bag;

e) transport means connected to the container panel comprising closed loop reversible handles consisting of a fixed handle and a moveable web handle permitting a workman to carry the bag;

f) closure means to permit a workman to move top edge of the bag between an open and closed position comprised of a plurality of spaced-apart holes along the top edge and a cord interwoven through the holes;

g) reversible zipper means including a double headed zipper extending about the peripheral edge to permit a workman to connect and disconnect the peripheral edge, so that the bag may move between;

i) a storage and carrying position wherein the peripheral edge is connected by the zipper means with the first side of the panel facing inwardly; and ii) a coplanar display and accessing position without the connection of the peripheral edges;

iii) a storage, accessing and carrying position wherein the peripheral edge is connected by the zipper means with the front side facing outwardly;

iv) an open and closed mode for the open top by moving a cord between a drawn/closed position and a released/open position;

v) a tool roll position wherein the wall is moved between the coplanar display and accessing position without the connection of the peripheral edges by rolling from right to left inwardly on the display panel and tying the roll thus formed with the cord; and in an alternate embodiment vi) a knapsack position wherein in the storage and carrying position straps are extended for use in carrying the tote bag on a worker's back.

13. A display bag for transporting and displaying fasteners comprising a container panel that is closable to form a nail bag, and operable to allow access thereto comprising:

a) a container means openable for forming a display apparatus and closable for forming a nail bag, constructed of foldable canvas fabric, comprising:

i) a container panel of generally rectangular construction having an inner and outer side and a one and other end;

ii) a semi detached bottom panel, hingedly attached adjacent one end of said container panel extending outwardly orthogonal relationship thereto;

b) a continuous seam extending around the peripheral edges of the container panel and bottom panel having a first fastener segment and a second fastener segment joined at a common point;

c) strap means for hanging the nail bag from a user's waist and for drawing the oval opening of the bag closed;

d) releasable closure means for closing the continuous seam to form a bag and for opening said continuous seam to form a planar display apparatus;

e) transport means connected to the container panel for carrying the display bag comprising a pair of handles;

f) display apparatus for organizing and displaying a plurality individual nail compartments fastened to the container panel in coplanar relation thereto formed of a foldable canvas material, whereby the releasable closure means is operative to move from the open position to the closed position to move from the open position to the closed position along the continuous seam panel, and forms an enclosed generally rectanguloid bag having a generally oval opening.

* * * * *